United States Patent [19]

Williams et al.

[11] 4,193,410

[45] Mar. 18, 1980

[54] APPARATUS FOR MAKING VENTILATED CIGARETTES

[75] Inventors: Robert E. Williams, Deptford, England; Clifford R. Marritt, Richmond, Va.

[73] Assignee: Molins, Limited, England

[21] Appl. No.: 880,104

[22] Filed: Feb. 22, 1978

[30] Foreign Application Priority Data

Feb. 22, 1977 [GB] United Kingdom ..... 7300/77

[51] Int. Cl.[2] ..... A24C 5/60

[52] U.S. Cl. ..... 131/170 R; 131/23 R

[58] Field of Search ..... 131/20 R, 21 R, 23 R, 131/23 A, 26, 32, 25, 27 R, 28, 83 R, 83 A, 253, 254, 255, 27 A, 88, 94, 96, 105, 170 R

[56] References Cited

U.S. PATENT DOCUMENTS

| | | | |
|---|---|---|---|
| 3,483,873 | 12/1969 | Hinzmann | 131/23 R |
| 3,701,353 | 10/1972 | Pasquine et al. | 131/23 R |
| 4,090,826 | 5/1978 | Hinzmann | 131/23 R |

*Primary Examiner*—V. Millin

*Attorney, Agent, or Firm*—Craig and Antonelli

[57] ABSTRACT

A cigarette perforating device for filter cigarettes in which the cigarettes are rolled between a drum and a rolling plate carrying perforator pins. The rolling plate is mounted on a pivot arm which is held in the operative position by an adjustable permanent magnet latch so that when a predetermined increase in pressure occurs in the device, due to a jam, the rolling plate can move away from the drum. This action also operates a switch controlling an electromagnetic catch retaining a conveyor carrying cigarettes away from the perforator so that damaged cigarettes are then dropped to waste.

10 Claims, 5 Drawing Figures

APPARATUS FOR MAKING VENTILATED CIGARETTES

This invention relates to apparatus for perforating the wrappers of cigarettes so as to provide a predetermined amount of ventilation when the cigarette is being smoked. A device of this kind has been proposed which works by rolling the cigarettes between two surfaces one of which carries sharp projections. If a cigarette or cigarettes should jam in the perforator, however, when it is used in association with modern high speed cigarette-making machinery, the succeeding cigarettes can accumulate very quickly in the gap between the surfaces. This, in turn, leads to the perforating device chewing up the cigarettes and generating debris which can rapidly be fed to storage and packing devices and result in considerable disruption of the manufacturing process.

A cigarette perforating device according to the invention comprises a pair of facing working members normally spaced apart by a distance equal to the diameter of a cigarette, at least one of the members being arranged to move, in use, so as to roll cigarettes against the other member, and at least one sharp projection from the surface of one of the members arranged to puncture the wrappers of the cigarettes as they are rolled over it, one of the members being so mounted that it can move away from its operative position so as to disengage from the cigarettes in the event of a fault, and being normally held in its operative position by retaining means which releases it in response to an increase in pressure in the device above a predetermined level.

Preferably the retaining means is adjustable so that it can be reset for different working pressures which may be required for different types of cigarettes.

In a preferred arrangement one of the members is a rotatable drum and the other member is a non-rotating "rolling plate" having a facing concave surface which extends partly circumferentially around the drum. The rolling plate is preferably releasably held in its working position by a magnetic latch mechanism, comprising a permanent magnet and a keeper device, one of which is connected to the fixed frame of the apparatus and the other of which is connected to the rolling plate, the arrangement being such that in the normal working position an air-gap is maintained between the magnet and the keeper. The air-gap is made adjustable so that the maximum penetrating force of the perforator, i.e., the force which is just less than that required to move the rolling plate away from its working position, can be adjusted.

Preferably the cigarettes are conveyed away from the perforator by a conveyor which is also releasably mounted and is arranged to be released so as to allow cigarettes to drop out of the conveying path when the releasable retaining means of the releasably mounted working surface is operated. When one of the surfaces is that of a rotatable drum, this conveyor may conveniently be normally horizontal and may be pivotally mounted at the axis of rotation of the drum and held in its normal working position by a catch. This catch, when released allows it to rotate to a slanting position in which it decants the damaged cigarettes into a waste receptacle.

One embodiment of the invention will now be described by way of example with reference to the accompanying drawings in which.

Figure 3:
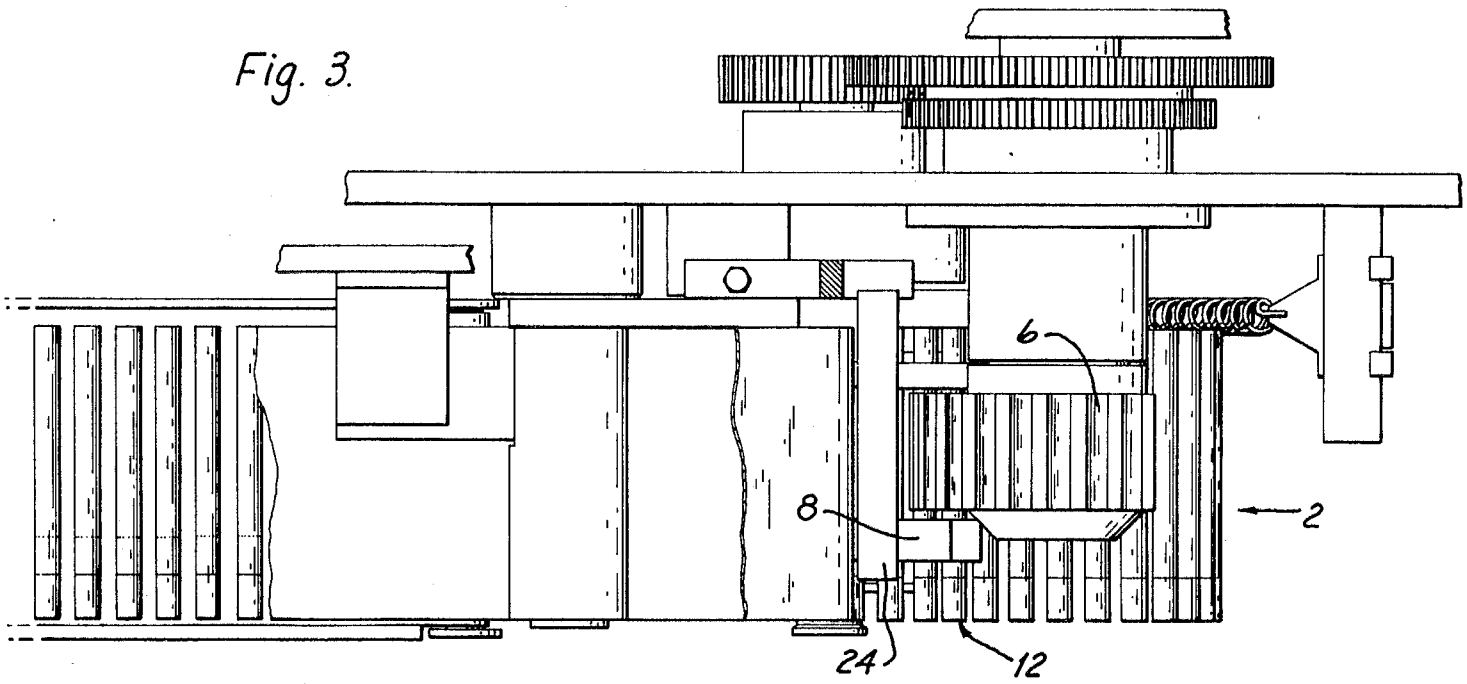
FIG. 3 is a plan view of the device of FIGS. 1 nd 2.
Figure 5:
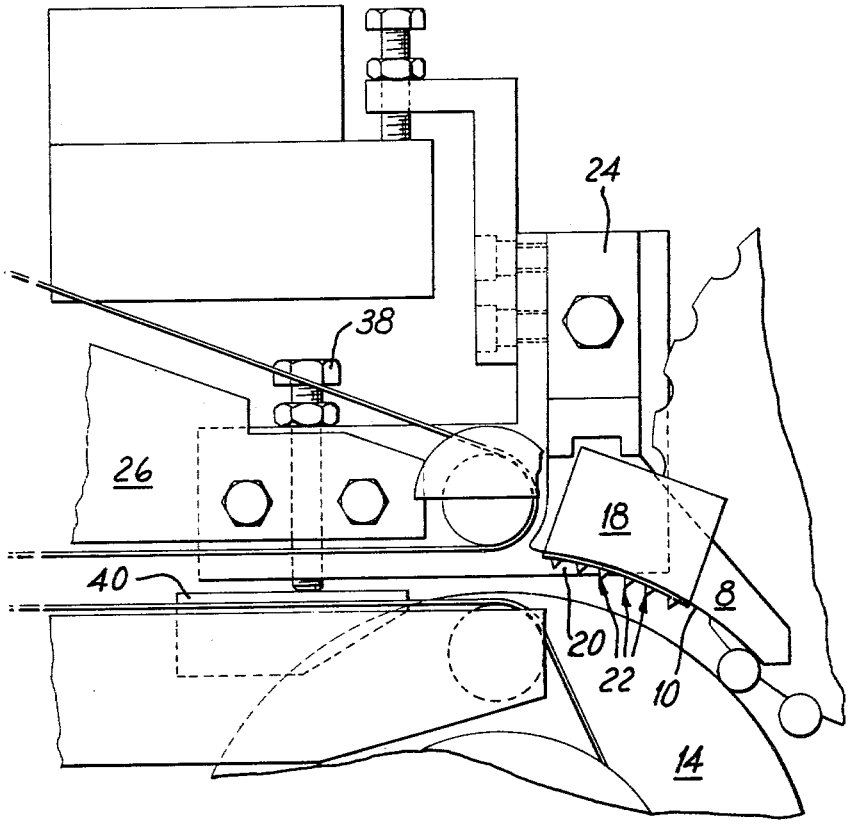
FIG. 5 is an enlarged partial view of the perforating unit showing the provisions for adjustment of the mechanism.

Referring to the drawings, cigarettes 2 to which filter plugs have already been attached are fed to a perforator unit 4 by a fluted drum 6. The depth of the drum 6 is rather less than the length of the cigarettes 2, so that it can be fed them positively beneath a finger forming the leading edge of a rolling plate 10, as shown in FIG. 3. Beneath the finger 8 and spaced away from it by the diameter of a cigarette (in the normal operation of the device), is a drum 14 having rubber tyres 16 which rotates in operation so as to continue the movement of the cigarettes through the perforator after they have been released by the fluted drum 6, by rolling then against the rolling plate 10. The rolling plate carries a blade member 18 (FIG. 5) which is arranged transversely to the axes of the cigarettes (i.e., parallel to their direction of movement) and has a lower operative edge 20 which extends beyond the rolling plate to engage the cigarettes and perforate them by means of a series of sharp teeth 22.

Figure 2:
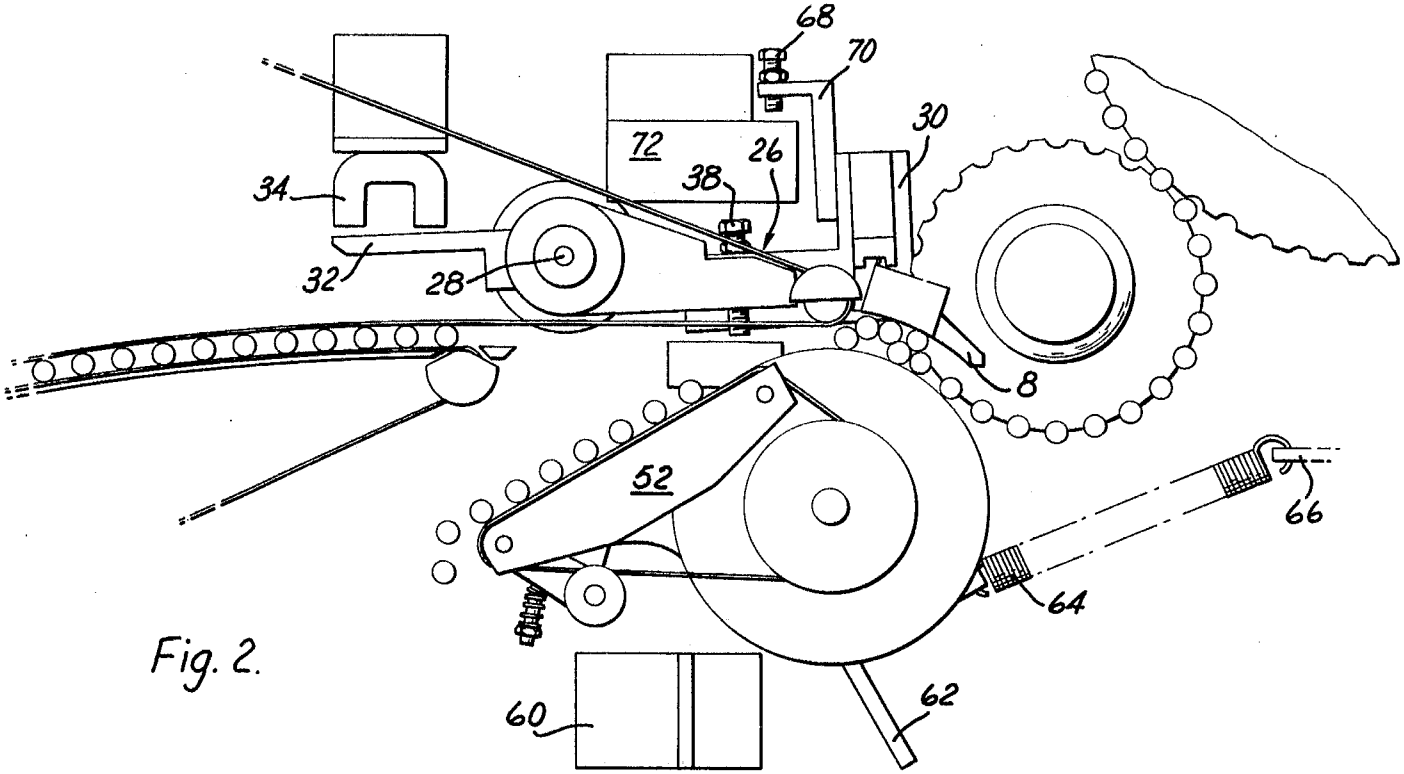
FIG. 2 is a view similar to FIG. 1 but showing the device after a jam has occurred.

The upper part of the apparatus comprises a rocker arm 26 whose pivot point 28 is downstream of the rolling plate 10 so that in the event of a jam a bracket 30 at the upstream end of the arm, carrying the rolling plate and blade assembly, can be lifted away from the drum 14 as shown in FIG. 2 (and described in more detail below). A pair of stop screws 38 in the pivot arm bearing against stop members 40 (FIG. 5) are used to set the gap between a transport pulley 44 carrying a drive belt 42, and the drum, for different diameter cigarettes. The rolling plate itself is mounted on a carrier 24 whose position is vertically adjustable by a small amount relative to the upper part of the apparatus, to allow for correction of the rolling plate position relative to the drum after the gap has been adjusted.

The downstream end of the arm, beyond the pivot point 28, carries a keeper 32 for a permanent magnet 34 which is mounted on a bracket on the frame of the apparatus. In the normal operative position, a small air gap 36 is maintained between the magnet and the keeper, and this gap can be adjusted by altering the position of the magnet mounting bracket, so that the retaining force exerted by the magnet can be varied. Thus the device can be so preset that when the finger 8 of the rolling plate is pushed upwardly by a larger force than that normally required to perforate the cigarette wrappers for example because of a jam, the counter-clockwise turning moment exerted on the rocker arm by this force will exceed the clockwise moment exerted by the magnet so that the keeper will initially move slightly further away, causing the force exerted by the magnet to be so reduced that the keeper will be completely released and the jammed cigarettes will be able to push the upstream end of the rocker arm upwardly as shown in FIG. 2.

Figure 1:
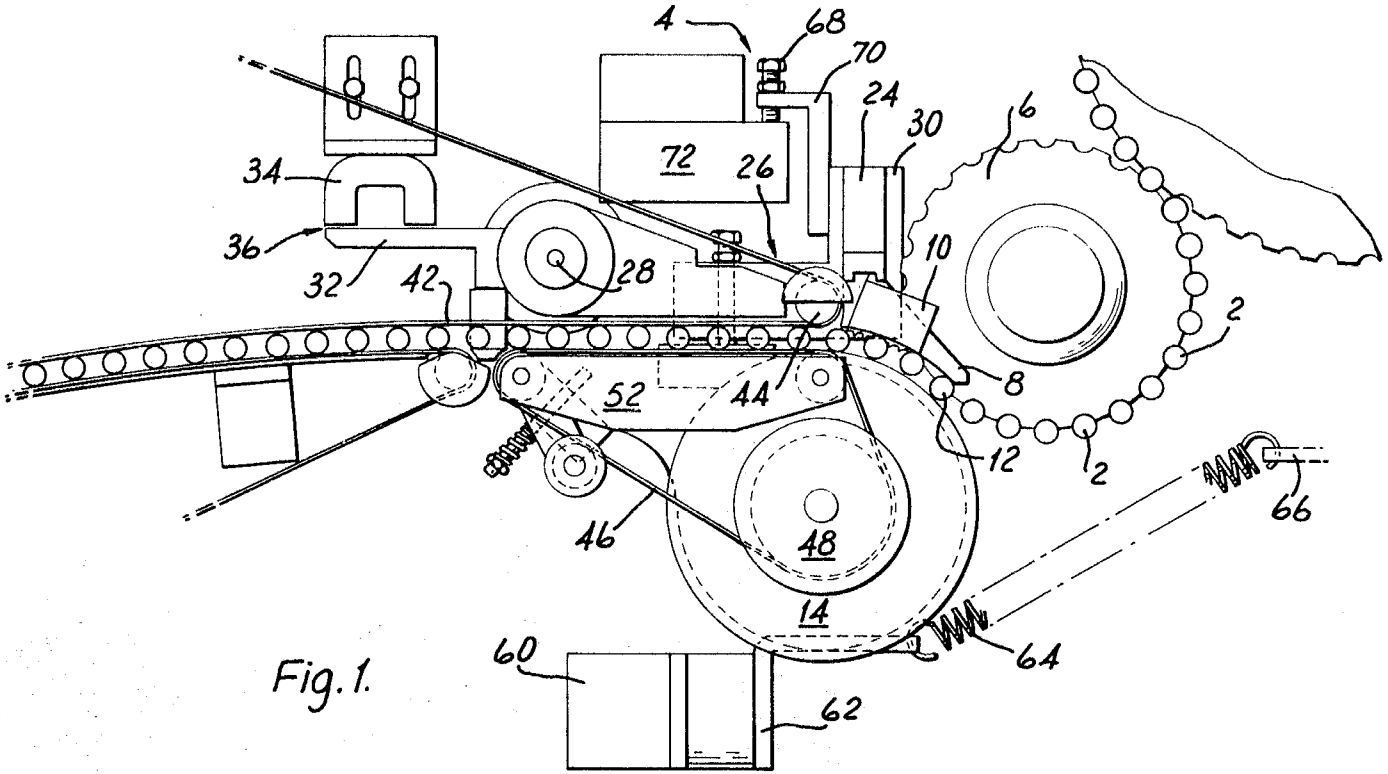
FIG. 1 is a side elevation of a device in accordance with the invention in its normal operating position.
Figure 4:
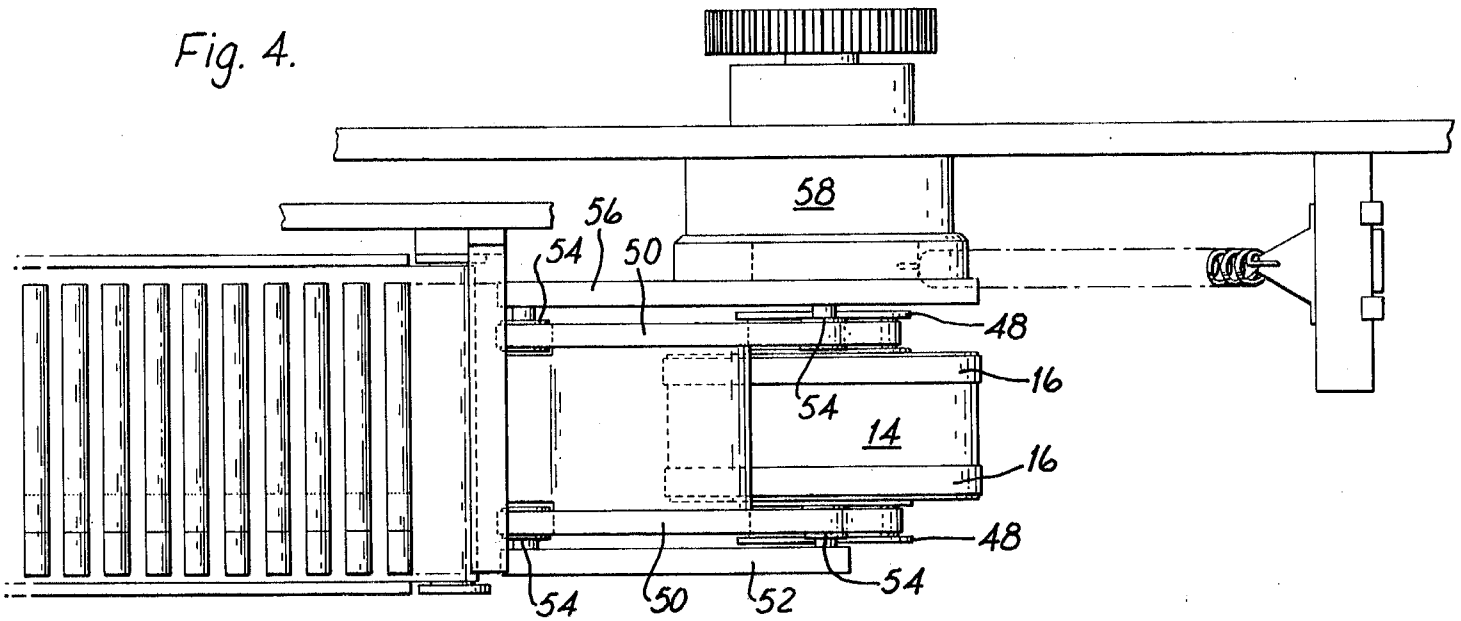
FIG. 4 is a similar view to that of FIG. 3 but with the upper part of the apparatus removed to show the cigarette feed path.

The cigarettes are normally carried away from the perforating station by being engaged between the conveyor 42 whose upstream end is trained around the pulley 44, and a lower conveyor which comprises two narrow bands 46 trained around pulleys 48 which are fixed to the same shaft as the drum 14, and which are each half the effective diameter of the drum (FIG. 4). The upper, normally horizontal flights 50 if the conveyor bands 46, which in use engage the cigarettes, pass over a carriage 52 which has roller guides 54 at each end defining the extent of these horizontal flights. The carriage 52 is mounted on a plate 56 fixed to a housing 58 coaxial with the shaft of the drum 14 and pulleys 48, and is normally held in the position shown in FIG. 1 by an electro-magnetic catch 60 engaging with a bracket 62 of magnetic material fixed to the bottom of the housing 58. A tension spring 64 connects the bracket 62 to a fixed point 66 on the frame of the device, so as to urge the housing 58 to rotate in a counter-clockwise direction (as seen in FIG. 1).

When a jam occurs in the perforator, as described above with reference to FIG. 2, the upstream end of the rocker arm lifts. This raises a stop-screw 68 which is threaded into a bracket 70 fixed to the rolling-plate-carrier 30, and disengages the stop-screw 68 from its engagement (FIG. 1) with a switch member 72. This action breaks the power supply circuit to the electromagnet 60, releasing the bracket 62, and thus allowing the carriage 52 to rotate to the position shown in FIG. 2. In this position debris resulting from the jam is decanted to waste by the narrow band conveyor. At the same time a high pressure jet on the transfer drum 6 is activated to prevent cigarettes reaching the perforator, and the cigarette-making machine may also be stopped.

We claim:

1. A cigarette perforating device comprising a pair of facing working members normally spaced apart by a distance equal to the diameter of a cigarette, means for feeding cigarettes into the space between the members, drive means for moving one of the members relative to the other so as to roll cigarettes between them, perforating means projecting from the surface of one of the members and arranged to puncture the wrappers of cigarettes as they are rolled between the members, movable mounting means for one of the said members, said mounting means being so arranged that the said one member can move away from its operative position; and releasable retaining means which normally retains the member in its operative position but responds to an increase in pressure, above a predetermined level, due to an incorrect feeding of the cigarettes by releasing the member so that it disengages from the cigarettes.

2. A cigarette perforating device according to claim 1 in which one of the working members is a rotatable drum and the other member is a non-rotating rolling plate having a concave surface facing the said drum.

3. A cigarette perforating device as claimed in claim 1 in which the retaining means comprises a magnetic latch.

4. A cigarette perforating device as claimed in claim 3 comprising a keeper connected to the rolling plate, movable mounting means for the rolling plate, a magnet cooperating with the keeper, and adjustable mounting means for the magnet, whereby an air-gap is maintained between the magnet and the keeper in the normal operating position; which air-gap is adjustable using the said adjustable mounting means, so as to vary the retaining force exerted on the rolling plate by the latch.

5. A magnetic perforating device as claimed in claim 3 comprising a magnet connected to the rolling plate, movable mounting means for the rolling plate, a keeper cooperating with the magnet, and adjustable mounting means for the keeper, whereby an air-gap is maintained between the magnet and the keeper in the normal operating position which air-gap is adjustable using the said adjustable mounting means so as to vary the retaining force exerted by the latch.

6. Apparatus as claimed in claim 1 further comprising conveyor means for conveying cigarettes away from the perforator; movable mounting means for the conveyor, releasable catch means connected to the conveyor, and actuating means for the releasable catch and arranged to be operated by movement of the movable working member.

7. Apparatus as claimed in claim 6 in which the said releasable catch is electromagnetic and the actuating means is a micro-switch.

8. Apparatus as claimed in claim 6 in which one of the working members is a rotatable drum, and the said conveyor is normally horizontal and is pivotally mounted at the axis of the drum and retained in position by the said releasable catch, whereby operation of the actuating means for the catch allows the conveyor to rotate about the axis of the drum so as to drop the cigarettes being conveyed.

9. Apparatus as claimed in claim 8 further comprising spring means urging the said conveyor to the rotated position.

10. Apparatus according to claim 1 further comprising control means adapted to interrupt the supply of cigarettes to the perforator, in response to release of the said working member from its operative position.

* * * * *